US005560735A

United States Patent [19]

Lammers

[11] Patent Number: 5,560,735

[45] Date of Patent: Oct. 1, 1996

[54] SUPPORT FOR DOCK-MOUNTED BOAT LIFTS

[75] Inventor: Tim E. Lammers, Boyden, Iowa

[73] Assignee: Dethmers Mfg. Co., Boyden, Iowa

[21] Appl. No.: 149,850

[22] Filed: Nov. 9, 1993

[51] Int. Cl.[6] ..... B63C 3/06

[52] U.S. Cl. ..... 405/1; 405/3

[58] Field of Search ..... 405/1–4; 114/44

[56] References Cited

U.S. PATENT DOCUMENTS

| | | | |
|---|---|---|---|
| 334,094 | 1/1886 | Staples | 405/2 |
| 2,505,832 | 5/1950 | Lange | 405/3 |
| 4,505,619 | 3/1985 | Sargent | 405/1 |
| 4,641,996 | 2/1987 | Seal | 405/2 |
| 4,678,366 | 7/1987 | Williamson | 405/3 |
| 4,773,346 | 9/1988 | Blanding et al. | 405/4 X |
| 4,983,067 | 1/1991 | Montgomery | 405/3 |
| 5,067,428 | 11/1991 | Dickerson et al. | 405/1 X |
| 5,143,182 | 9/1992 | Basta | 187/11 |

*Primary Examiner*—John A. Ricci

*Attorney, Agent, or Firm*—Riddell, Williams, Bullitt & Walkinshaw

[57] ABSTRACT

A watercraft lift is disclosed herein having an optional support (10) for anchoring the lift to the floor of a body of water. The support (10) comprises a leg (12) having a first end (14) releasably attached to the load member (48) and second end (18) for anchoring in the floor of a body of water. The second end (18) includes a foot (20) to hold the support (10) in position and prevent further sinking into the floor. The first end (14) is slideably mounted on the load member (48) and fixedly held in place by a pair of elongated bars (36) threadably attached to a plate (16) mounted on the first end (14). The support (10) of the present invention is particularly adaptable for use with portable docks.

18 Claims, 1 Drawing Sheet

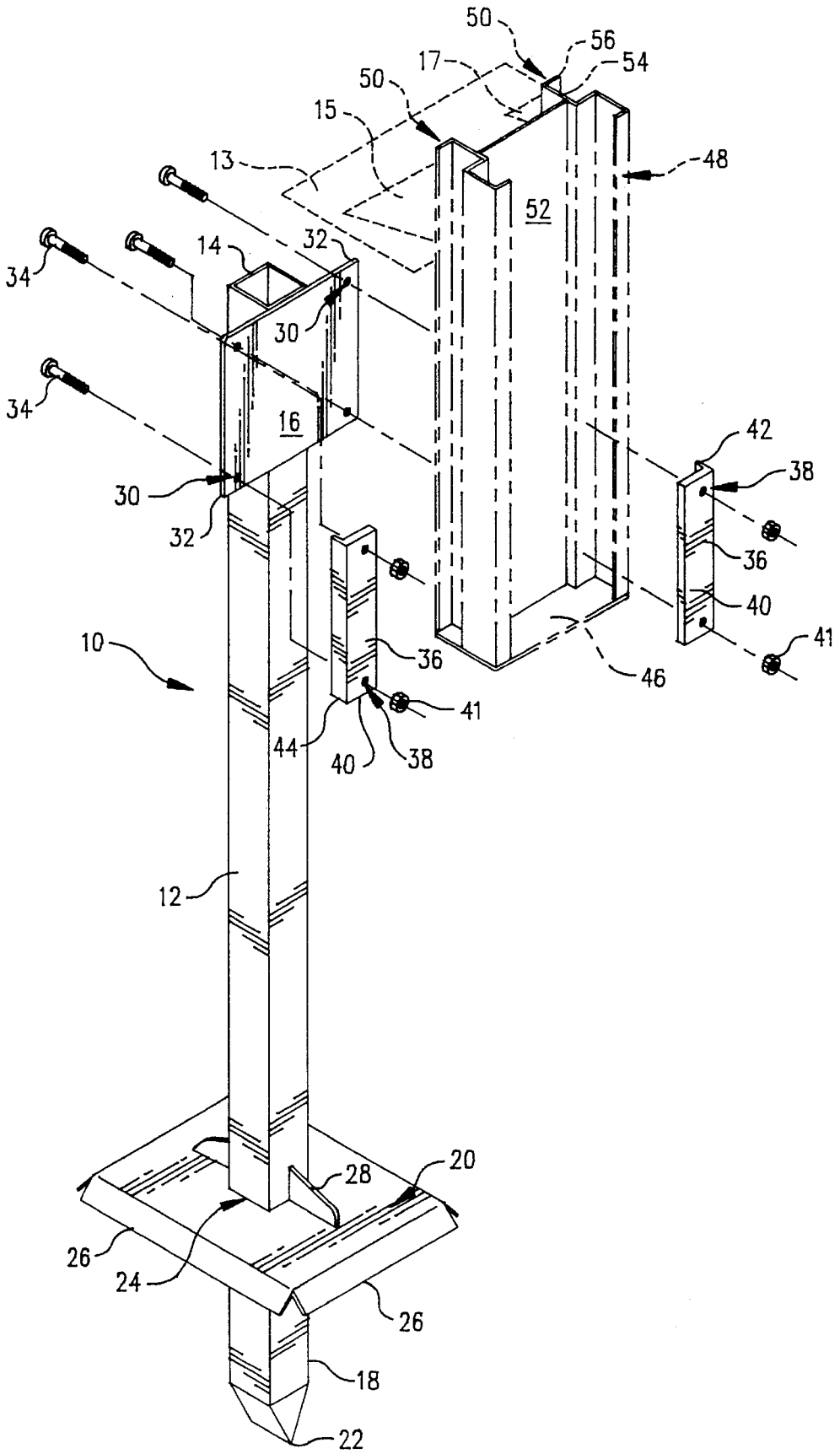
50
56
54
17
50
15
13
48
52
14
32
34
30
34
16
42
38
30
32
36
40
41
10
36
46
41
44
40
38
12
20
28
26
24
26
18
22

SUPPORT FOR DOCK-MOUNTED BOAT LIFTS

TECHNICAL FIELD

The present invention pertains to an apparatus for lifting small watercraft from the water, and, more particularly, to a support leg adaptable for attachment to such lifting apparatus for anchoring the lifting apparatus when used in conjunction with portable docks.

BACKGROUND OF THE INVENTION

Owners of personal watercraft, such as small boats, canoes, dinghies, jet skies, and similar marine craft, frequently launch and retrieve their watercraft from a dock or pier. To assist in these tasks, there have been developed watercraft lifts that mount on the dock. These dock-side lifts enable the owner or user to gently lower the watercraft into the water and easily and quickly remove the same from the water.

An example of such a lift is disclosed in U.S. Pat. No. 5,143,182, issued to Samuel T. Basta on Sep. 1, 1992, for a Low-Profile Watercraft Lift. As disclosed therein, the lift includes a base mounted on a dock and a load-bearing member attached to the base. The load-bearing member depends downward adjacent the dock and partially into the body of water. A carriage mounted on the load-bearing member moves up and down relative to the water as controlled by a winch on the top of the load-bearing member. This apparatus is mounted on the top surface of the dock and has no attachment to the side of the dock and no support on the floor of the body of the water.

Another device is disclosed in U.S. Pat. No. 4,983,067, issued to Montgomery on Jan. 8, 1991, for a Boat Lift Apparatus. This apparatus is mounted on the top and on the side of a dock and extends downward into the water. A load-bearing member is secured to a piling upholding the dock for lateral stability. In addition, the load-bearing member is shown anchored to the floor of the body of water by an extendable tube mounted inside a rail. The drawback to this device is that bracing to the dock is required for vertical stability. Another drawback is the lack of attachment between the extendable inner tube that is anchored in the floor and the rail portions in which it is mounted. In order words, it is possible for the lift apparatus to be raised up while the inner tube is anchored in the floor of the body of water. Thus, heavy loads exerted on one side of a portable dock may cause the portable dock to twist or otherwise move in an undesirable fashion. The apparatus of Montgomery would fail to prevent such movement because the anchored inner tube is not attached to the load member.

In addition, U.S. Pat. No. 4,678,366, issued on Jul. 7, 1987, to Williamson for a Boat Lift shows a vertical H-beam driven into the floor of a body of water adjacent a pier. The H-beam is used as a track on which a shaft housing and boat lift slides up and down. Williamson does not teach or suggest the use of an optional support leg for supporting the boat lift on the floor of the body of water. Rather, the load-bearing member, i.e., the vertical H-beam, is itself driven directly into the floor of the body of water. This device makes no provision for variance in the depth of the water and the height of the dock because the dock is a fixed structure.

Consequently, there is a need for a watercraft lift that is adequately anchored in the floor of a body of water when mounted on a portable dock and fixedly attached to the lift while permitting adjustment for variance in dock height and water depth.

SUMMARY OF THE INVENTION

The present invention is directed to a support for a boat lift, the boat lift having a base mounted on a dock that is in a body of water. The lift includes a load member extending downward partially into the water adjacent the dock. The support comprises a rigid, elongated support member having a first end configured for attachment to the boat lift and an opposite second end configured for anchoring in the floor of the body of water. The support further includes an attaching device for attaching the support member to the boat lift, and preferably to the boat load member. The attaching means is configured to enable slidable positioning of the support member at any location along the load member prior to fixedly attaching the support member.

In accordance with another aspect of the present invention, the attaching device comprises at least one gripping member for gripping the boat lift load member. Ideally, the gripping member comprises a jaw threadably attached to the support member for releasable clamping or gripping onto a flange on the load member. In one embodiment, the jaw comprises at least one elongated bar having openings for fasteners to pass therethrough.

In accordance with another aspect of the present invention, the support further includes a foot or plate mounted on the support member adjacent the second end. The plate provides a large supporting surface for contact with the floor of the body of water to maintain the support member in its anchored position when under load and to prevent further sinking of the support member into the floor after installation.

As will be readily appreciated from the foregoing, the support is initially slidably attached to the boat lift to enable selective positioning of the support with respect to the lift. Once the desired position of the support member is achieved, it is fixedly attached or clamped to the boat lift, thus maintaining vertical support in both upward and downward direction. The support includes a foot that maintains the support in position in the floor of the body of water and prevents further sinking of the support after installation.

BRIEF DESCRIPTION OF THE DRAWINGS

The foregoing and other features and advantages of the present invention will become more readily appreciated as the same becomes better understood from the detailed description of the invention when taken in conjunction with the following drawings wherein:

The figure is an isometric projection of the support formed in accordance with the present invention in a partially exploded format.

DETAILED DESCRIPTION OF THE PREFERRED EMBODIMENT

Referring to the figure, illustrated therein is the support 10 formed in accordance with the present invention. The support 10 comprises an elongated, rigid leg 12 having a first end 14, on which is mounted a plate 16, and a second end 18, on which is mounted a foot 20. The second end 18 of the leg 12 has a pointed tip 22 to facilitate sinking or driving of the leg 12 into the floor of a body of water.

Ideally, the leg 12 is formed from aluminum alloy to prevent corrosion. As can be seen in the figure, the leg has a substantially square cross-sectional configuration. However, it is to be understood that other cross-sectional configurations, such as rectangular or circular, may be used without departing from the spirit and scope of the invention.

The foot 20 comprises a sheet of aluminum alloy having a square shape with flanged edges 26 on each of its sides. An aperture 24 in the center of the foot 20 is sized and shaped to enable the foot 20 to be slidably received over the second end 18 of the leg 12 and is preferably welded in place a short distance from the tip 22 of the second end 18. A pair of stops 28 can be included that project outward from the leg 12 to prevent the foot 20 from sliding further up the leg 12. These stops 28 consist of a flat piece of aluminum that project out of opposing sides of the leg 12. The foot 20 has each of the four edges 26 angled slightly downward towards the tip 22 to facilitate gripping on the floor of the body of water.

At the first end 14 of the leg 12 is a plate 16 that is positioned in a plane that is substantially orthogonal to the plane of the foot 20. In order words, when the support 10 is in use, the plate 16 will be in substantially a vertical orientation. Openings 30 are formed in each corner 32 of the substantially square-shaped plate 16. These openings are sized and shaped to allow a threaded fastener 34 to pass therethrough, as indicated by the dashed lines.

A pair of elongated bars 36 are attached by the fasteners 34 to the sides of the plate 16, as indicated. The bars 36 are positioned on the plate 16 so that the longitudinal axis of the bars 36 have a vertical orientation. Openings 36 are formed at each longitudinal end 40 of the bars 36 that are sized and shaped to allow the fasteners 34 to pass therethrough. Nuts 41 are threadably received on the fasteners 34 to hold the bars 36 in place on the plate 16.

Each of the bars 36 has an L-shaped cross-sectional configuration. In other words, there is a small elongated flange 42 projecting off one side 44 of the bars 36. When the bars 36 are fastened to the plate 16, the flanges 42 hold the bars 36 away from the plate 16 to form a groove.

Illustrated in phantom in the figure is a portion of a load member 48, which is part of a larger boat lift. While the boat lift will not be described in detail herein, the specification of U.S. Pat. No. 5,143,182 issued to Samuel T. Basta on Sep. 1, 1992, is incorporated herein by reference, including the figures and associated detail description. Reference is made particularly to FIGS. 1 and 2 thereof, which show in detail the configuration of the load-bearing member illustrated herein in phantom and identified as reference number 48. The load member 48 shown herein in FIG. 1 has a pair of L-shaped flanges 50 extending outward from a partition 52. The L-shaped flanges 50 have a stem 54 extending outward at substantially a right angle from the partition 52 and a leg 56 formed at substantially a right angle to the stem 54. It is this leg 56 depending from each flange 50 that fits in the groove formed by the bar 36 and the plate 16 on the support 10. The horizontal spacing between the bars 36 on the plate 16 is preselected to allow the support 10 to slide on the load member 48 with little or no resistance. The bottom plate 46 on the load member 48 prevents the support from sliding off the flanges 50. Once the nuts 41 are tightened down, they exert pressure on the bars 36, which causes them to clamp or grip the leg 56 on the flanges 50, thus fixedly attaching the support to the load member. Depending outward at substantially a right angle from the load bearing member 48 is a base 13 to facilitate mounting of the load member 48 to a dock. Gussets 15 and 17 reinforce the attachment of the base 13 to the load member 48.

In use, the support 10 is brought into contact with the flanges 50 on the load member 48. The plate 16 on the first end of the leg 12 should be parallel to and adjacent the legs 56 on the flanges 50. The bars 36 are then placed over the flanges 50 with the flanges 42 on the bars 36 bearing against the plate 16. With the fasteners 34 placed through the openings 30 in the plate 16 and the openings 38 in the bars 36, the nuts 41 are lightly threaded onto the fasteners 34. The boat lift with the attached support 10 is then mounted on the dock or pier, as shown in FIG. 1 of U.S. Pat. No. 5,143,182.

Once the boat lift is firmly affixed to the dock or pier, final adjustments are made for the depth of the water. The support 10 is adjusted on the load member 48 so the tip 22 on the second end 18 of the leg 12 is sunk or driven into the floor of the body of water until the foot 20 rests firmly on the floor. The foot 20 prevents excessive sinking of the leg 12 under load, and maintains the support 10 in position on the floor of the body of water. The nuts 41 are then tightened to cause the bars 36 to grip or clamp the flanges 50 firmly to the plate 16. The load member 48 is now anchored to the floor of the body of water.

The support of the present invention is particularly useful in this regard when used in conjunction with portable docks. Because portable docks lack adequate support for the additional loads imposed by watercraft hoisted out of the water, the support 10 of the present invention, when properly used, reduces the risk of damage to portable docks.

While a preferred embodiment of the present invention has been illustrated and described herein, it is to be understood that various changes may be made without departing from the spirit and scope of the invention. For instance, the second end 18 of the leg 12 may be configured to allow the foot 20 to be attached at different locations on the second end 18 of the leg 12 to accommodate the floor conditions in the body of water. In addition, the bar clamp configuration illustrated and described herein with respect to bars 36 and plate 16 may be replaced with other commercially available clamping or gripping devices to accommodate different configurations of load members 48, as long as such devices permit the support 10 to slide along the length of the load member 48. Consequently, the scope of the invention is to be limited only by the claims that follow.

The embodiments of the invention in which an exclusive property or privilege is claimed are defined as follows:

1. A support for a boat lift, the lift having a base mounted on a portable dock in a body of water and a load member extending downward partially into the water adjacent the dock, the support comprising a rigid, elongated support member having a first end configured for attachment to the boat lift load member and an opposing second end configured for anchoring on the floor of the body of water; and means for attaching said support member to the boat lift load member, said attaching means being configured to enable slidable positioning of said support member on said load member.

2. The support of claim 1, further comprising a foot attached to said support member for holding said support member in position on the floor of the body of water.

3. The support of claim 2, wherein said attaching means comprises a means for clamping said first end of said support member to the boat lift load member.

4. The support of claim 3, wherein said clamping means comprises at least one clamp attached to said first end of said support member for releasably clamping the load member.

5. The support of claim 4, wherein said clamping means comprises a pair of bars threadably attached to said first end of said support member for releasably clamping the load member.

6. The support of claim 5, wherein said foot comprises a plate mounted on said support member near said second end in substantially a perpendicular orientation to said support member.

7. The support of claim 3, wherein said clamping means comprises a bar threadably attached to said first end of said support member for releasably clamping the load member.

8. In a low-profile watercraft lift, the lift having a base for mounting on a dock in a body of water and further having a structural member extending downward adjacent the dock and partially into the water, the improvement comprising a support leg having one end configured for slidable engagement to the structural member to enable slidable positioning of said support leg on said structural member and the other end configured for anchoring in the floor of the body of water, and means for releasably attaching said support leg to the structural member and for enabling selective positioning of said support leg at any location on the structural member.

9. The improvement of claim 8, wherein said attaching means comprises a means for gripping the structural member.

10. The improvement of claim 9, wherein said gripping means is mounted on said support leg.

11. The improvement of claim 10, wherein said gripping means comprises at least one jaw mounted on said support leg for releasably gripping the structural member.

12. The improvement of claim 10, wherein said gripping means comprises two jaws for releasably gripping the structural member.

13. The improvement of claim 8, further comprising a foot attached to said structural member for bearing against the floor of the body of water and positioned a preselected distance from said other end to enable the structural member to be driven into the floor of the body of water and to remain in position and resist further sinking into the floor of the body of water after attachment to the structural member.

14. A dock-mounted apparatus for lifting watercraft from a body of water, comprising:

a base configured for mounting the apparatus on a dock;

means mounted on said base for lifting a watercraft from the water adjacent the dock, including a load member extending downward adjacent the dock and partially into the water;

a support leg attached at one end only to said load member and configured for anchoring at the other end only to the floor of the body of water; and means for slidably attaching said support leg to said load member to enable selective positioning of said support leg on said load member.

15. The apparatus of claim 14, wherein said attaching means is configured to enable selective positioning of the support leg relative to the load member without removing the support leg from engagement with the load member.

16. The apparatus of claim 15, wherein said attachment means comprises at least one clamp.

17. The apparatus of claim 16, wherein said clamp is attached to said support leg for releasably gripping said load member.

18. The apparatus of claim 17, wherein said support leg further includes a foot mounted adjacent said other end of said supporting leg for holding said support leg in position on the floor of the body of water and preventing further driving of said support leg into the floor of the body of water when under load.

* * * * *